US010971812B2

(12) United States Patent
Martinez Ortigosa et al.

(10) Patent No.: US 10,971,812 B2
(45) Date of Patent: Apr. 6, 2021

(54) BROADBAND ANTENNA SYSTEM

(71) Applicant: Advanced Automotive Antennas, S.L.U., Barcelona (ES)

(72) Inventors: Enrique Martinez Ortigosa, Barcelona (ES); Ramiro Quintero Illera, Barcelona (ES)

(73) Assignee: ADVANCED AUTOMOTIVE ANTENNAS, S.L.U., Barcelona (ES)

( * ) Notice: Subject to any disclaimer, the term of this patent is extended or adjusted under 35 U.S.C. 154(b) by 10 days.

(21) Appl. No.: 16/163,038

(22) Filed: Oct. 17, 2018

(65) Prior Publication Data

US 2019/0123436 A1 Apr. 25, 2019

(30) Foreign Application Priority Data

Oct. 17, 2017 (EP) ..... 17382689

(51) Int. Cl.

| | |
|---|---|
| ***H01Q 1/48*** | (2006.01) |
| ***H01Q 9/04*** | (2006.01) |
| ***H01Q 21/28*** | (2006.01) |
| ***H01Q 9/42*** | (2006.01) |
| ***H01Q 5/30*** | (2015.01) |
| ***H01Q 1/24*** | (2006.01) |
| ***H01Q 1/32*** | (2006.01) |
| ***H01Q 21/06*** | (2006.01) |

(52) U.S. Cl.

CPC ..... *H01Q 1/48* (2013.01); *H01Q 1/241* (2013.01); *H01Q 1/3233* (2013.01); *H01Q 5/30* (2015.01); *H01Q 9/0414* (2013.01); *H01Q 9/0421* (2013.01); *H01Q 9/42* (2013.01); *H01Q 21/065* (2013.01); *H01Q 21/28* (2013.01); *H01Q 1/32* (2013.01)

(58) Field of Classification Search

CPC ..... H01Q 1/48; H01Q 9/42; H01Q 21/28; H01Q 21/065

See application file for complete search history.

(56) References Cited

U.S. PATENT DOCUMENTS

| | | | | |
|---|---|---|---|---|
| 5,365,246 | A * | 11/1994 | Rasinger | H01Q 1/243 343/702 |
| 6,903,693 | B1 * | 6/2005 | Lee | H01Q 1/2291 343/700 MS |
| 2004/0012528 | A1 * | 1/2004 | Dai | H01Q 1/36 343/702 |
| 2004/0140935 | A1 * | 7/2004 | Korva | H01Q 9/0414 343/700 MS |

(Continued)

FOREIGN PATENT DOCUMENTS

| | | | |
|---|---|---|---|
| WO | 2012001729 | A1 | 1/2012 |
| WO | 2015164010 | A1 | 10/2015 |

*Primary Examiner* — Dieu Hien T Duong

(74) *Attorney, Agent, or Firm* — Brooks Kushman, P.C.

(57) ABSTRACT

A broadband and multiband antenna of reduced dimension, preferably to be used as external antenna for vehicles is disclosed. The antenna system includes an antenna comprising: a planar ground plane, a planar radiating element having a configuration formed by a central segment and first and second lateral segments extending from the central segment. A feed connection line is connected between the central segment and an edge of the ground plane, and a ground connection line is connected between the central segment and said edge of the ground plane.

20 Claims, 6 Drawing Sheets

(56) References Cited

U.S. PATENT DOCUMENTS

| | | | | |
|---|---|---|---|---|
| 2005/0024272 | A1 | 2/2005 | Ponce De Leon et al. | |
| 2006/0250310 | A1 | 11/2006 | Yeh et al. | |
| 2009/0091504 | A1* | 4/2009 | Licul | H01Q 1/521 343/718 |
| 2010/0060528 | A1* | 3/2010 | Chiu | H01Q 1/243 343/700 MS |
| 2016/0197395 | A1 | 7/2016 | Ziv | |

* cited by examiner

FIG. 1A
PRIOR ART
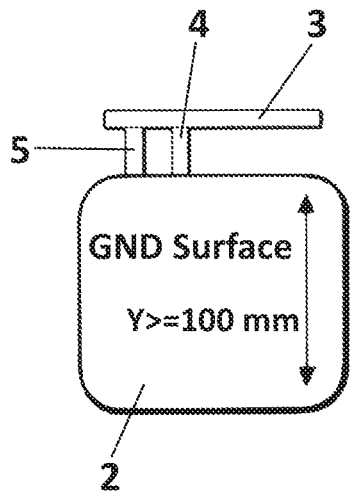
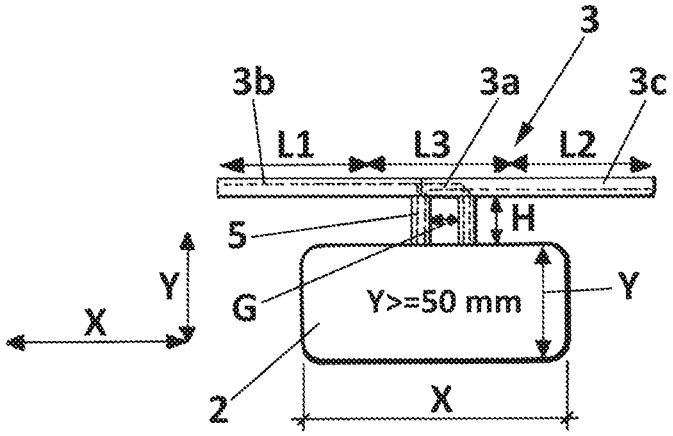
FIG. 1B
FIG. 2A
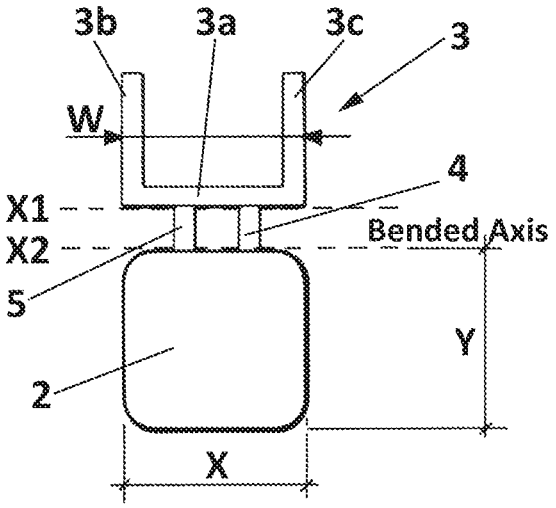
FIG. 2B
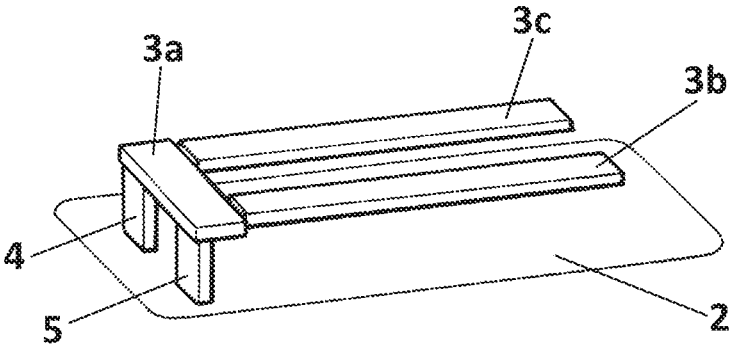

FIG. 3A
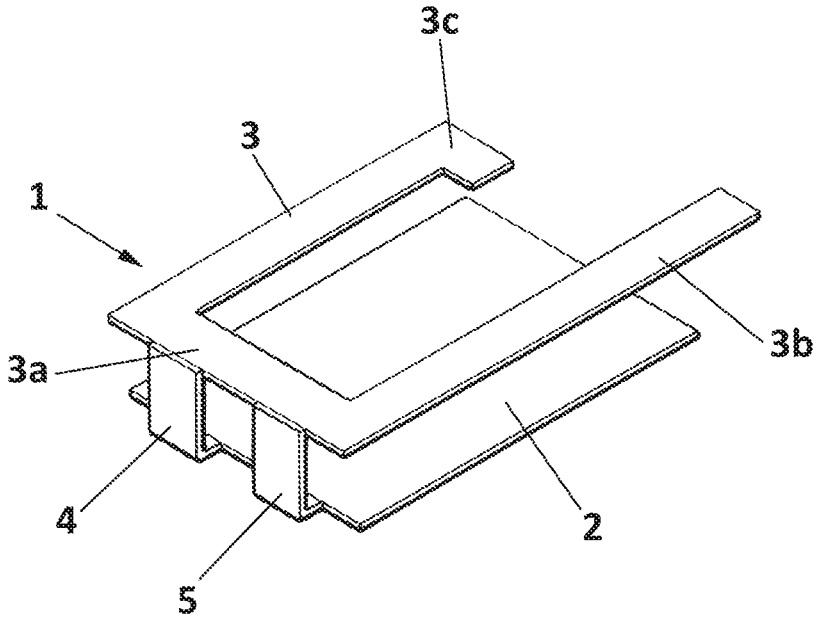
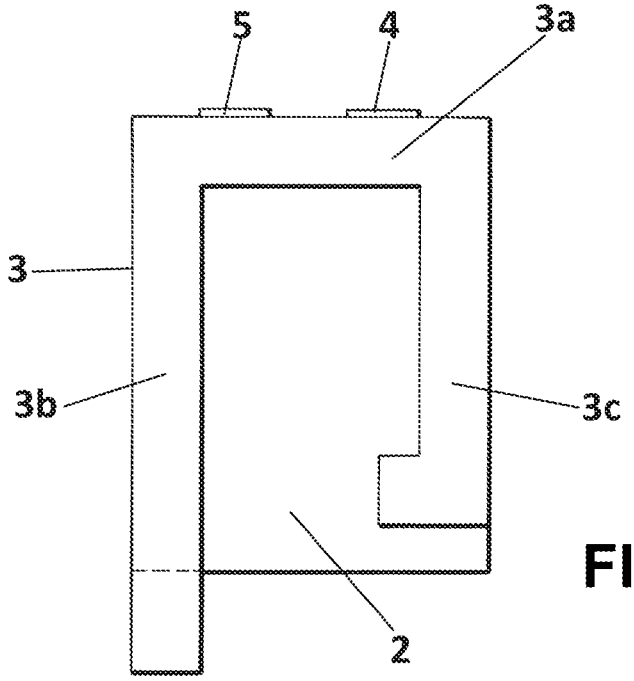
FIG. 3B

FIG. 5A
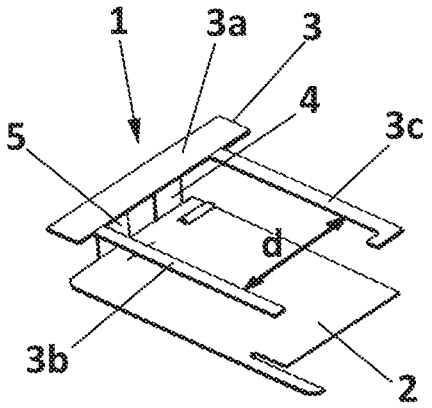
FIG. 5B
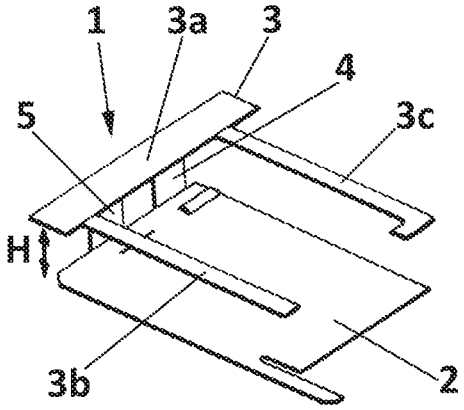
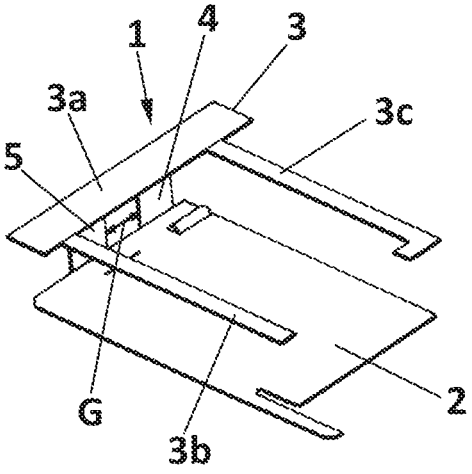
FIG. 5C
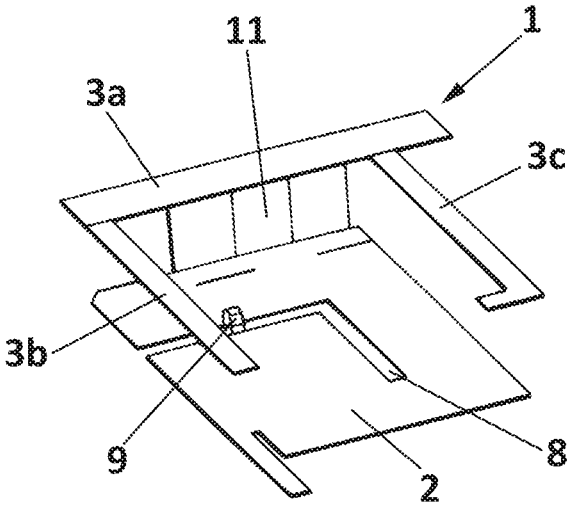
FIG. 5D

BROADBAND ANTENNA SYSTEM

CROSS-REFERENCE TO RELATED APPLICATIONS

This application claims foreign priority benefits under 35 U.S.C. § 119(a)-(d) to EP 17382689.2 filed Oct. 17, 2017, the disclosure of which is hereby incorporated by reference in its entirety.

TECHNICAL FIELD

The present disclosure refers in general to broadband and multiband antennas, preferably to be used as remote antennas for vehicles.

An object of the disclosure is to provide a broadband and multiband antenna of reduced dimensions, that can be fitted within a confined space for example inside a vehicle.

Another object of the disclosure is to provide a remote antenna for vehicles that can be simply attached by itself, that is, without additional attaching means, to a vehicle, and without ground connection to the vehicle, thereby reducing manufacturing costs.

BACKGROUND

Due to the large size of some electronic devices, it is difficult to accommodate a large antenna system inside a reduced space. For this reason, many communication devices of motor vehicles require external antennas to increase the performance of an internal antenna. In that scenario, it is critical that the dimension of the external antenna be as small as possible so that it can be fitted inside a reduced space within a vehicle.

Another advantage of the external antenna respect internal antennas is its performance in terms of electronic noise. Internal antennas should obtain worst sensitivity of the whole system as being nearer of the electronic noise sources (clocks, microprocessors, etc.). Therefore, in case of the external antennas this situation is improved as they can be moved out from these noise sources.

For example, LTE (Long Term Evolution) antennas in particular require at the same time both a main antenna and a diversity antenna. However, these two LTE antennas (main and diversity) cannot be accommodated in the narrow interior of a shark fin antenna, especially in the low frequency band (700 MHz-1 GHz), wherein signal interference is high, and the level of the uncorrelation obtained between the antennas will be poor. When more than one antenna is needed on a mobile system as LTE, antennas must be as uncorrelated as possible between them.

On the other hand, planar inverted F antennas (PIFAs) are commonly used in wireless communications, e.g., cellular telephones, wireless personal digital assistants (PDAs), wireless local area networks (LANs)-Bluetooth, etc. A PIFA antenna generally includes a planar radiating element, and a ground plane that is parallel to the radiating element, wherein this ground plane is larger than the antenna's structure. An electrically conductive first line is coupled to the radiating element at a first contact located at an edge on a side of the radiating element, and that first line is also coupled to the ground plane.

An electrically conductive second line is coupled to the radiating element along the same side as the first line, but at a different contact location on the edge than the first line. The first and second lines are adapted to couple to a desired impedance, e.g., 50 ohms, at frequencies of operation of the PIFA. In the PIFA, the first and second lines are perpendicular to the edge of the radiating element to which they are coupled, thereby forming an inverted F shape (thus the descriptive name of planar inverted F antenna).

Prior known planar inverted F antennas have sacrificed bandwidth by requiring a reduction in the volume of the PIFA for a given wireless application. Moreover, their performance is strongly related with the physical dimensions of the ground plane where the antenna is connected. Normally, for properly functionality at lowest frequency of the cellular bands (as example of LTE) a ground plane larger than 100 mm is needed.

Therefore, there is a need for improving the bandwidth of a PIFA without having to increase the volume thereof, and without using larger ground plane for the antenna installation.

Furthermore, it is a challenge to integrate a multiband, high efficient, low VSWR antenna in this reduced dimension.

SUMMARY

The antenna includes two inverted F antennas in order to increase antenna efficiency, in terms of radiation and bandwidth, so that due to the co-operation between the two F antennas, the size of the ground plane is reduced. The antenna can be implemented either as a 2D planar antenna, or as a 3D volumetric antenna.

An aspect of the disclosure refers to a broadband and multiband antenna system including an antenna device which comprises: a substantially planar ground plane and a substantially planar radiating element. In the 2D planar antenna, the radiating element and the ground plane are coplanar, and in the 3D implementation the radiating element is arranged above the ground plane and it is substantially parallel to the ground plane.

The radiating element has a central segment and first and second lateral segments extending from the central segment. A feed connection line is connected between the central segment and a side of the ground plane, and a ground connection line is connected between the central segment and the same side of the ground plane to which the feed connection line is connected.

The radiating element has a U-shaped configuration, formed by a central segment and first and second lateral segments extending from the central segment. A feed connection line is connected between the central segment and the ground plane, and a ground connection line is connected between the central segment and the ground plane.

Preferably, the radiating element and the ground plane are configured as a double PIFA antenna.

Preferably, the segments of the radiating element are substantially straight, and the first and second lateral segments are substantially parallel to each other and substantially orthogonal to the central segment. The ground plane has a substantially rectangular configuration with two short sides and two longer sides, and the central segment is placed above one of the short sides, and the lateral segments are placed respectively above the longer sides.

The antenna system of the disclosure is preferably adapted to operate at least within one Long Term Evolution (LTE) frequency band, and to be used as remote antenna for a motor vehicle.

Some of the advantages of the disclosure are the followings:

High efficiency;

Wideband behavior;

Multiband behavior;

Ultra reduced dimensions compared with prior solutions;

All in one part (antenna+ bracket) no additional structures for installation;

Compatible with navigation antenna integrated inside.

BRIEF DESCRIPTION OF THE DRAWINGS

Preferred embodiments of the disclosure, are henceforth described with reference to the accompanying figures, wherein:

FIGS. 1A and 1B show a schematic representation of the 2D planar antenna topology, wherein FIG. 1A is a prior-art inverted F antenna, and FIG. 1B is a π antenna according to one embodiment.

FIGS. 2A and 2B show a schematic representation of the evolution of the 2D planar antenna of FIG. 1, to be converted into a 3D volumetric antenna, wherein FIG. 2A shows a first step of the evolution, and FIG. 2B shows the final 3D antenna.

FIGS. 3A and 3B show a perspective view and a top plan view respectively, of a schematic representation of an antenna according to one embodiment.

FIGS. 5A through 5D show in perspective view, several schematic representations of the antenna according to one embodiment.

DETAILED DESCRIPTION

Figure 4A:
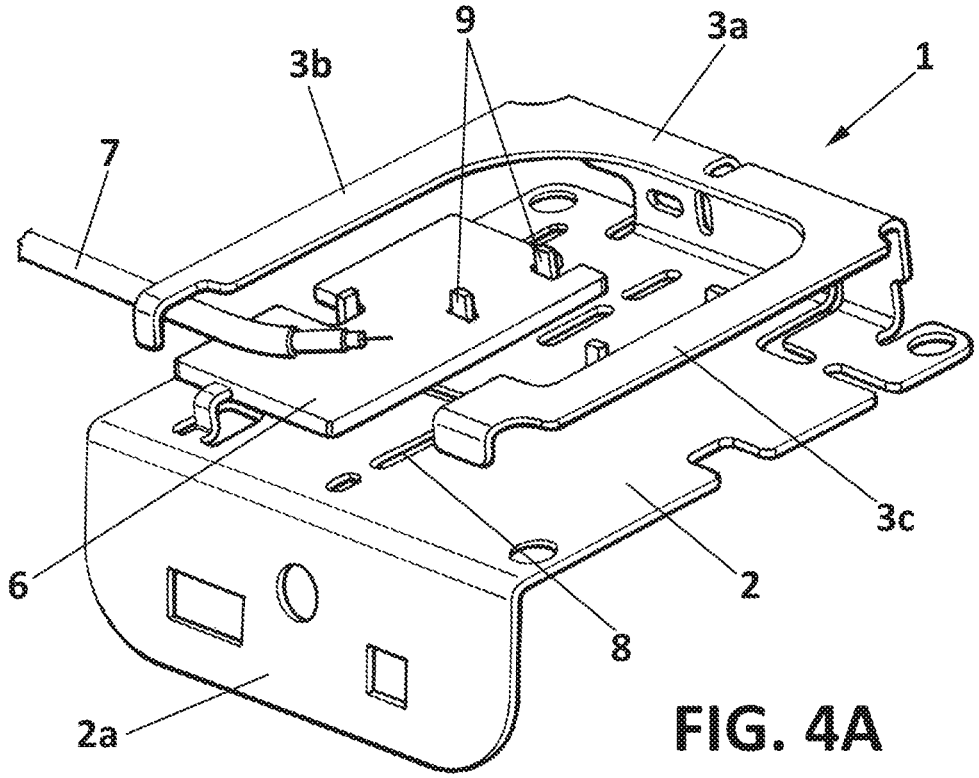
FIGS. 4A and 4B show two perspective views of an exemplary implementation of the antenna system according to one embodiment.

The antenna can be implemented either as a 2D planar antenna, or as a 3D volumetric antenna. In the case of a planar implementation as shown in FIG. 1B, the antenna configuration could be defined as "π antenna".

The π antenna shown in FIG. 1B comprises a radiating element (3) having a first and second lateral segments (3*b*, 3*c*) extending from a central segment (3*a*) of length (L3). The lengths (L1, L2) of the first and second lateral segments (3*b*, 3*c*) are similar (+/−15%), and they are selected depending on a first side (Y) of the ground plane (2) perpendicular to the radiant element (3) for each particular application.

In this embodiment, the radiating element (3) and the ground plane (2) are coplanar. In addition, the first, second and central segments (3*a*, 3*b*, 3*c*) are straight and are aligned, and are placed at one side of the ground plane (2).

Optimal implementation is obtained with the ratio of L1+H length being around 50-70%, preferably 55-65%, and more preferably 60%, greater than the ground plane axis dimension "Y" as shown in FIG. 1B, and wherein (H) is the distance between the radiating element (3) and one side of the ground-plane (2) as represented in FIG. 1B.

For example in the case of an implementation of a cellular band with the lowest frequency of operation at 700 MHz (A. 428 mm), and with an implementation of the ground-plane with "Y" dimension 0.12 A. (50 mm), it requires L1 (63 mm)+H (20 mm). In this case Y/(L1+H) results in 50/(63+20)=0.60, that is, around 60% of increased branch length versus the ground-plane major axis (Y) dimension.

The distance (H) has a minimum value to avoid higher coupling effect to the ground-plane, that would reduce the antennas impedance and bandwidth. Normally, minimum H value is around 0.05 A., in the case of cellular band with the lowest frequency of operation at 700 MHz, the minimum value for "H" will be around 20 mm.

A feed connection line (4) is connected between the central segment (3*a*) and a side of the ground plane (2), and a ground connection line (5) is connected between the central segment (3*a*) and the same side of the ground plane (2) to which the feed connection line (4) is connected. Therefore, the radiating element (3) and the feed and ground connection lines (4, 5) together configure a "π" shape.

A gap (G) between connection lines (4, 5) of the "π antenna", also has an influence of the antenna's radiation property, as the two inverted "F" antennas are not excited properly. Normally the range of values to obtain the benefits of the new "π antenna" is over the range 0.035 to 0.05 A., therefore in the case of cellular band with the lowest frequency of operation at 700 MHz the range should be 15 to 20 mm.

As shown in FIG. 2B, a 3D compact solution is obtained as an evolution of FIG. 1B, by bending first and second lateral segments (3*b*, 3*c*) to form a "U" shape. The width (W) of this U-shape (corresponding approximately to the length L3 of the central segment (3*a*)) is similar than the length of a second side (X) of the ground plane (2), said second side (X) being perpendicular to the first side (Y).

Finally, the radiant element (3) is firstly folded 90° respectively about a folding axis (x1), and finally the connection lines (4, 5) are folded 90° respectively about folding axis (x2) as shown in FIG. 2A, to form a 3D implementation as an "U" shaped antenna (FIG. 2B).

With the 3D implementation is possible to keep the volume of the antenna within the perimeter of the ground plane, that is, within the surface dimension (X, Y) keeping a similar antenna's performance than the planar structure solution of FIG. 1B.

FIG. 3A shows an example of an antenna (1), comprising a planar ground plane (2) and a planar radiating element (3) arranged above the ground plane (2) and substantially parallel to the ground plane (2). The radiating element (3) has a U-shaped configuration, having a central segment (3*a*) and first and second lateral segments (3*b*, 3*c*) extending from the central segment (3*a*).

The segments (3*a*, 3*b*, 3*c*) of the radiating element (3) are straight and contains a rectangular part. The first and second lateral segments (3*b*, 3*c*) are parallel to each other and orthogonal to the central segment (3*a*). In a preferred embodiment, as the one shown in FIG. 3B, the first and second lateral segments (3*b*, 3*c*) are placed right above two parallel sides of the ground plane (2).

The ground plane (2) has a generally rectangular configuration having two pairs of parallel sides, and wherein the central segment (3*a*) is placed above one side, and the lateral segments (3*b*, 3*c*) are placed respectively above the other two perpendicular sides.

As shown in FIG. 3A, there is the possibility that one of the lateral segments be longer than the other one, in this case, the lateral segment (3*b*) is longer than segment (3*c*).

Furthermore, in the embodiment of FIG. 3A, the segment (3*b*) is longer than the ground plane (2). Segment (3*c*) is shorter than the ground plane (2), and its free end is bended towards the center of the ground plane, configuring an "L" shape.

In other preferred embodiments, the gap (G) between connection lines (4, 5) could be avoided by using a slot on the ground-plane (2). This slot generates an electrical path between points equivalent to the gap (G) with the advantage of reducing also the lowest frequency of operation of the antenna.

Figure 4B:
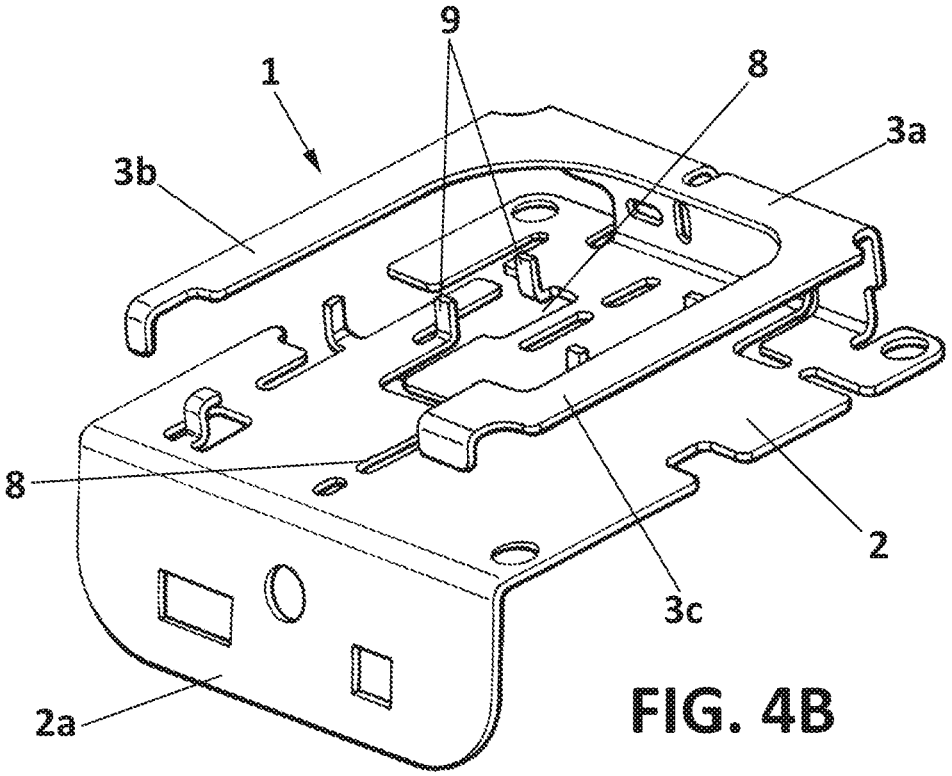

For example, in the alternative embodiments of FIGS. 4A, 4B, and 5D, the ground plane (2) has at least one slot (8) as a tuning antenna slot (8*a*) for tuning the antenna to the desired operating frequency. The ground plane (2) may have other slots (8*b*) with mechanical function as part of fixation means. Furthermore, the ground plane (2) has a part bended (2*a*) over to be used as a bracket for installing the antenna. In this embodiment, there are no connection lines (4, 5) connected between the radiating element (3) and the ground plane (2). It could be said that in the embodiments of FIGS. 4A, 4B and 5D, the gap (G) between connection lines (4, 5) is zero, and that there is a connection (11) between the radiating element (3) and the ground plane (2).

Additionally, the antenna (2) is complemented with a printed circuit board (6) attached to the ground plane (2), wherein the printed circuit board (6) has a matching network for the antenna system, and a coaxial cable (7) for the antenna output.

The tuning antenna slot (8*a*) is a straight groove having two edges (9), so that a feed line of the antenna system (having two terminals, not shown), namely a feed terminal and a ground terminal), are connected respectively with said edges (9). The position and shape of the slot (8) configure two paths for the current circulation in the ground plane.

FIG. 5A shows an embodiment wherein the distance (d) between the first and second lateral segments (3*b*, 3*c*) is about 0.1λ, being λ the lowest frequency of operation.

FIG. 5B shows an embodiment wherein the height (H) between the radiating element (3) and the ground plane (2) is higher than 0.05λ, being λ the lowest frequency of operation.

FIG. 5C shows an embodiment wherein the feed connection line (4) and the ground connection line (5) are straight and parallel to each other, and wherein the gap (G) between the two connection lines (4, 5) is within the range 0.05λ-0.035λ, being λ the lowest frequency of operation (wherein λ=430 mm for 700 MHz).

Figure 6:
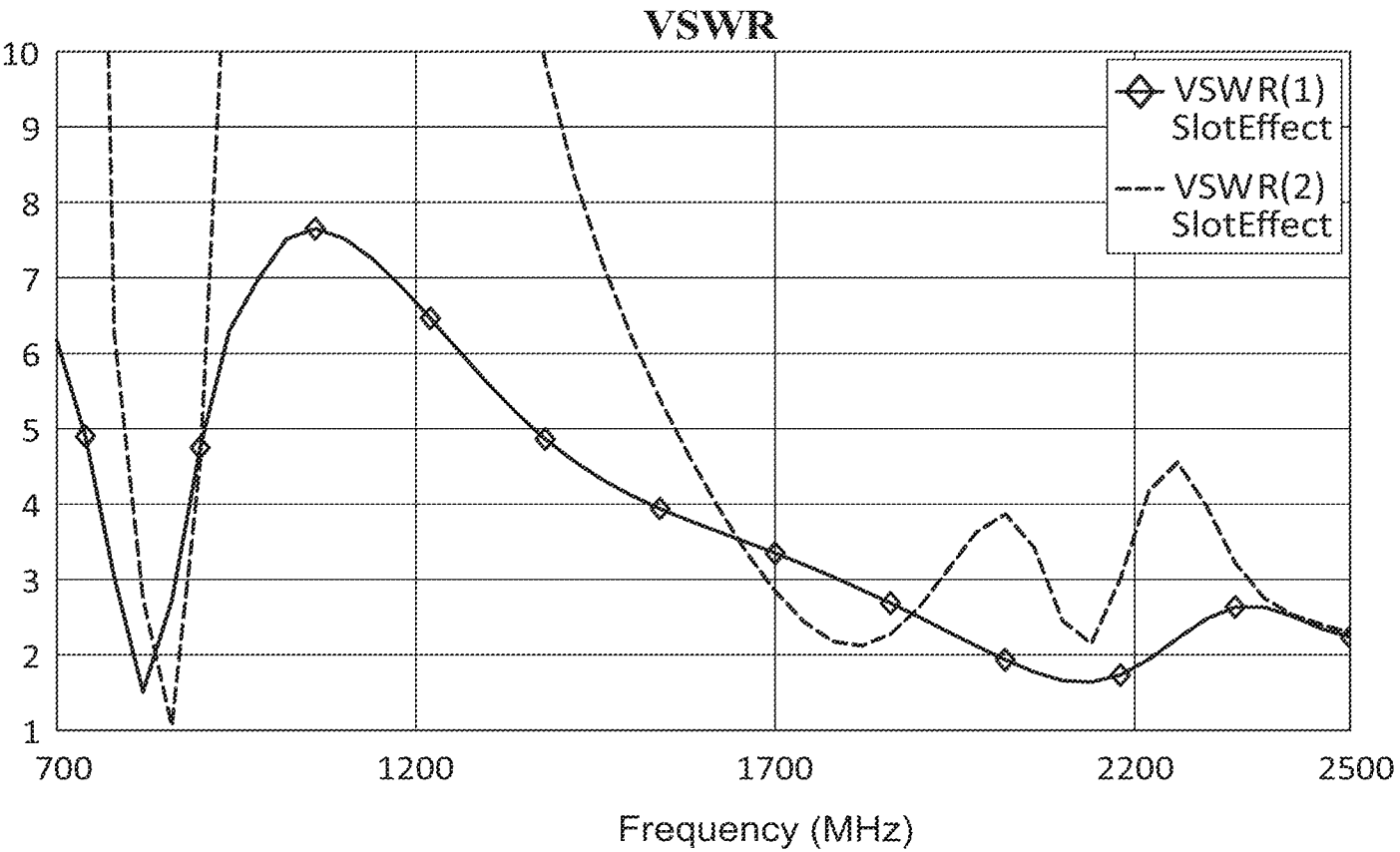
FIG. 6 shows a graph corresponding to the measured VSWR (Voltage Standing Wave Ratio).

FIG. 5D shows an embodiment wherein the gap (G) between the two connection lines (4, 5) is equal to 0, and the ground plane (2) has a slot (8) with a total perimeter around 0.25λ; and FIG. 6, also shows a graph corresponding to the measured VSWR (Voltage Standing Wave Ratio), showing the effects of that slot (8), getting the GND to be resonant at lowest frequencies than the obtained with the design with the two connection lines (4, 5) separated, being A the lowest frequency of operation.

The antenna system is adapted to operate at least within one Long Term Evolution (LTE) frequency band. The lowest frequency of operation is 700 MHz.

Figure 7:
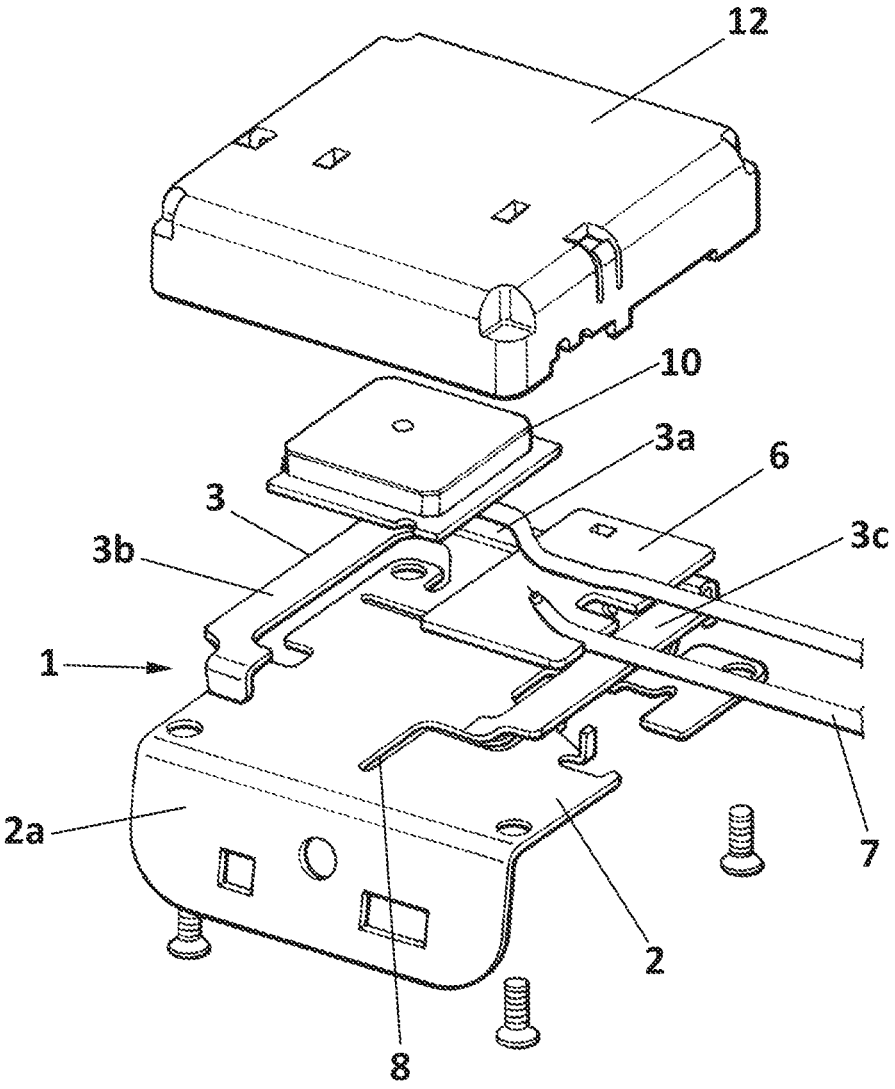
FIG. 7 shows an exploded view of an antenna system according to the invention.

Finally, FIG. 7 shows a complete antenna system comprising the antenna (1) previously described, an additionally including a satellite navigation antenna (GNSS) (10), and a casing (12) to protect and isolate the antenna. In order to be shielded by the two lateral segments (3*b*, 3*c*), the GNSS antenna (10) is arranged between these two lateral segments.

Therefore, the antenna system is characterized by the following combination of features and properties:

π antenna,

Slotted ground wherein there is no distance between connection lines,

Antenna matching in PCB,

Printed antenna in PCB for high freq,

Compatible structure to allow navigation satellite antenna inside,

Very high bandwidth: (700-960 MHz, 1600-2800 MHz), VSWR<2.5 on the 95% of the bandwidth, Radiation efficiency over 30%, up to 60% at high frequencies, Compact shape: 3D 60×60×15 $mm^3$, Compatible structure to integrate a satellite navigation antenna (GNSS).

What is claimed is:

1. An antenna system including an antenna, the antenna comprising:

a planar ground plane;

a planar radiating element, having a central segment, a first lateral segment, and a second lateral segment, each extending from the central segment, wherein the radiating element has a U-shaped configuration and further wherein one of the first and second lateral segments is +/−15% longer than the other;

a single feed connection line connected between the central segment and a side of the ground plane; and a single ground connection line connected between the central segment and the same side of the ground plane to which the feed connection line is connected, wherein the feed connection line and the ground connection line, are straight and parallel to each other, and wherein a gap between the two connection lines is zero, and further wherein the ground plane defines at least one slot, the slot having at least one groove and wherein the slot has two edges and further comprising a feed line having a feed terminal and a ground terminal, the terminals being connected respectively with the edges.

2. The antenna system according to claim 1 wherein the radiating element and the ground plane are coplanar.

3. The antenna system according to claim 1, wherein the radiating element is arranged above the ground plane and substantially parallel to the ground plane.

4. The antenna system according to claim 3, wherein the ground plane has a substantially rectangular configuration having two pair of parallel sides, and wherein the central segment is placed above one of the sides, and the lateral segments are placed respectively above the other two perpendicular sides.

5. The antenna system according to claim 1, wherein the segments of the radiating element are substantially straight, and wherein the first and second lateral segments are substantially parallel to each other and substantially orthogonal to the central segment.

6. The antenna system according to claim 1, wherein a distance between the first and second lateral segments is about 0.1λ, with λ being the wavelength at the lowest frequency of operation.

7. The antenna system according to claim 1, wherein a height between the radiating element and the ground plane is greater than 0.05λ, with λ being the wavelength at the lowest frequency of operation.

8. The antenna system according to claim 1, wherein the feed connection line and the ground connection line are straight and parallel to each other, and wherein a gap between the two connection lines is within the range 0.05λ-0.035λ, with λ being the lowest frequency of operation.

9. The antenna system according to claim 1, wherein the lowest frequency of operation is 700 MHz.

10. The antenna system according to claim 1, further comprising a printed circuit board attached to the ground plane.

11. The antenna system according to claim 1, further comprising a satellite navigation antenna (GNSS) fixed to the ground plane and arranged between the lateral segments.

12. The antenna system according to claim 1, wherein the distance between the radiating element and one side of the ground plane is higher than 0.05λ, with λ being the wavelength at the lowest frequency of operation.

13. An antenna including an antenna, comprising:

a planar ground plane;

a planar radiating element, having a central segment, a first lateral segment, and a second lateral segment, each extending from the central segment;

a feed connection line connected between the central segment and a side of the ground plane; and a ground connection line connected between the central segment and the same side of the ground plane to which the feed connection line is connected, wherein the feed connection line and the ground connection line, are straight and parallel to each other, and wherein a gap between the two connection lines is zero, and further wherein the ground plane defines at least one slot, the slot having at least one groove.

14. The system according to claim 10, wherein the slot has two edges and further comprising a feed line having a feed terminal and a ground terminal, the terminals being connected respectively with the edges.

15. An antenna system configured to operate at least within one Long Term Evolution (LTE) frequency band, comprising:

a ground plane;

a radiating element having a central segment, and first and second lateral segments;

a feed connection line connected to the central segment and the ground plane, wherein one of the first and second lateral segments is +/−15% longer than the other; and a ground connection line connected to the central segment and the ground plane to which the feed connection line is connected, wherein the feed connection line and the ground connection line, are straight and parallel to each other, and wherein a gap between the two connection lines is zero, and further wherein the ground plane defines at least one slot, the slot having at least one groove.

16. The antenna system according to claim 15, wherein the radiating element and the ground plane are coplanar.

17. The antenna system according to claim 15, wherein the radiating element is arranged above the ground plane and substantially parallel to the ground plane, and wherein the radiating element has a U-shaped configuration.

18. The antenna system according to claim 17, wherein the ground plane has a substantially rectangular configuration having two pair of parallel sides, and wherein the central segment is placed above one of the sides, and the lateral segments are placed respectively above the other two perpendicular sides.

19. The antenna system according to claim 15, wherein the segments of the radiating element are substantially straight, and wherein the first and second lateral segments are substantially parallel to each other and substantially orthogonal to the central segment.

20. The antenna system according to claim 15, wherein a distance between the first and second segments is about 0.1λ, with λ being the lowest frequency of operation.

* * * * *